US007287367B2

(12) United States Patent
Birkenmaier et al.

(10) Patent No.: US 7,287,367 B2
(45) Date of Patent: Oct. 30, 2007

(54) CLOSING MEMBER FOR COMPRESSED AIR CARRYING POLYGONAL TUBES ON A YARN SPINNING MACHINE

(75) Inventors: Wilhelm Birkenmaier, Weinstadt (DE); Jürgen Schlegel, Fellbach (DE)

(73) Assignee: Texparts GmbH, Fellbach (DE)

( * ) Notice: Subject to any disclaimer, the term of this patent is extended or adjusted under 35 U.S.C. 154(b) by 184 days.

(21) Appl. No.: 11/151,379

(22) Filed: Jun. 13, 2005

(65) Prior Publication Data

US 2005/0229578 A1 Oct. 20, 2005

Related U.S. Application Data

(63) Continuation of application No. PCT/EP03/13263, filed on Nov. 26, 2003.

(51) Int. Cl.
*D01H 5/18* (2006.01)

(52) U.S. Cl. ..... 57/315; 19/272

(58) Field of Classification Search ..... 57/315–331; 19/272

See application file for complete search history.

(56) References Cited

U.S. PATENT DOCUMENTS 5,673,549 A * 10/1997 McNeill ..... 57/333
2005/0183244 A1* 8/2005 Pape et al. ..... 19/236

FOREIGN PATENT DOCUMENTS

| | | |
|---|---|---|
| DE | 33 15 305 A | 10/1984 |
| DE | 37 32 132 A | 4/1989 |
| DE | 198 29 403 A | 1/2000 |
| DE | 198 30 048 A | 1/2000 |

* cited by examiner

*Primary Examiner*—Shaun R. Hurley
(74) *Attorney, Agent, or Firm*—Alston & Bird LLP

(57) ABSTRACT

A closing member 1 for compressed air carrying polygonal tubes, which is inserted in a sealing manner into the polygonal tube at one end thereof. The closing member 1 includes an elastic sealing element 3, and the closing member is constructed such that it biases in its inserted state the sealing element 3 in such a manner that it seals and secures the closing member 1 relative to the polygonal tube 8. Closing members of this type are used to seal mounting tubes in yarn spinning machines with pneumatically loaded top roller support and weighting arms.

19 Claims, 3 Drawing Sheets

CLOSING MEMBER FOR COMPRESSED AIR CARRYING POLYGONAL TUBES ON A YARN SPINNING MACHINE

CROSS REFERENCE TO RELATED APPLICATION

The present application is a continuation of international application PCT/EP2003/013263, filed 26 Nov. 2003, and which designates the U.S. The disclosure of the referenced application is incorporated herein by reference.

BACKGROUND OF THE INVENTION

The present invention relates to a closing member for compressed air carrying polygonal tubes of the type used as a mounting rod for the drafting system in a yarn spinning machine.

In such spinning machines, pneumatically loadable top roller support and weighting arms are used, which are secured by means of brackets to a mounting rod of the machine. The mounting rod is hollow and serves at the same time as a compressed air delivery line. A drafting system of this type is described, for example, in DE 198 29 403 A1.

DE 198 30 048 A1 discloses a mounting rod that is formed from polygonal tube sections, with each tube section being provided at its ends with closing members. A mounting rod that is composed of individual tube sections permits a modular construction of the mounting rod and compressed air supply for spinning machines of different lengths. The closing members are inserted in a sealing manner into the ends of the polygonal tube sections. Between the polygonal tube sections, the compressed air is conducted through a connecting tube section which interconnects the closing members of two adjacent sections.

Sealing of non-circular hollow sections with elastic sealing elements, such as O-rings with a circular cross section, or with special section rings, presents problems, inasmuch as irregularities of the special section of the sealing element causes in the latter only a certain equalization of internal tension, without the sealing element filling all zones of the hollow section in a uniform and sealing manner. It is therefore preferred to use in the case of polygonal hollow sections, pasty sealing substances of a suitable viscosity, which must completely fill a sealing channel that is formed by the hollow section and an inserted sealing element. It is however difficult to fill the sealing channel evenly and completely, as well as in a process safe manner in the case of series production. This requires a great expenditure for production and testing. The sealing effect is often not stable for a long duration because of the aging behavior of the sealing substance and because of operational stress, for example, as a result of pressure changes. Thus a reliable, lasting sealing is not ensured.

If leakages occur in operation, sealing elements of the described type are hard to disassemble and cannot be reused. It is therefore often necessary to exchange the entire special section tube length. Likewise, the sealing substance is able to only a very limited extent retain the sealing element in the required position against the inner pressure in the special section tube. This requires additional special measures, for example, the installation of pins for securing the sealing element against axial displacement.

If an adhesive is used as sealing substance to increase the hold of the sealing element in its position at the end of the polygonal tube, it will be difficult and costly to disassemble the closing member. In this case, the closing members and, possibly, even the polygonal tube will no longer be suited for immediate reuse.

At their ends, the polygonal tubes are supported in recesses of brackets that are also known as stands, and secured in position by means of screw connections. To this end, a mounting screw extends through the special-section tube in its end region, which also mounts the respective closing member. By tightening the mounting screw, the polygonal hollow section may undergo elastic or plastic deformations, whereby the sealing effect is additionally put at risk.

Based on the foregoing state of the art, it is an object of the invention to overcome the above limitations and deficiencies of the known closing members.

SUMMARY OF THE INVENTION

The above and other objects and advantages of the invention are achieved by the provision of a closing member which is configured for being inserted in an end of a compressed air carrying polygonal tube on a yarn spinning machine, and which comprises an elastic sealing element, and with the closing member being configured such that it axially biases in its inserted state the sealing element, whereby the sealing element expands so as to seal the closing member relative to the polygonal tube.

The closing member of the invention seals the polygonal tube in a reliable and stable manner for a long duration. It is no longer necessary to secure it in addition, for example, by means of formfitting retaining pins against displacement by the air pressure that builds up in the interior of the polygonal tube, since the closing member is adequately secured in a force-locking engagement, when its sealing function is activated. In comparison with closing members of the known prior art, assembly and disassembly of the closing members are facilitated. The closing members and polygonal tubes are reusable, without having to perform additional labor, such as, for example, cleaning.

A closing member is constructed such that compressed air is allowed to flow from the polygonal tube through the closing member and into the closing member of an adjacent tube. This permits applying axial pressure to the sealing element in a uniform manner, and achieving a reliable sealing effect.

The closing member preferably comprises an end piece and a counterpart with the sealing element being constructed and arranged between the end piece and the counterpart. This permits sealing and securing at the same time, after the closing member has been inserted into the polygonal tube. It is also easy and simple to release the closing member from its secured position and to remove it from the polygonal tube.

The end piece and the counterpart are interconnected by a threaded member that extends through the sealing element, and by tightening the threaded member the end piece and the counterpart move toward each other and bias the sealing element with axial pressure. This also provides adequate space for the compressed air channel, which ensures the necessary passage of the compressed air, and it permits in addition the threaded member to engage the counterpart in the center, which counteracts a tilting of the counterpart when the threaded member is tightened. In addition, the configuration of the end piece and counterpart in the region of the compressed air channel makes it possible to prevent the parts of the closing member from being joined in an incorrect position.

The insertion of a connecting tube into the opening of the closing member, which is formed in its end face by the compressed air channel, ensures the passage of compressed air between two polygonal tubes in a simple manner.

To insure adequate and reliable sealing effect, the length of the sealing element preferably amounts to at least 1.5 times its wall thickness. Also, the sealing element is preferably formed of rubber which provides desirable elastic properties.

The end piece of the closing member may include a recess which is sized to receive differently sized mounting screws. A supporting contour provided on both sides of the recess of the end piece counteracts a deformation of the hollow tube even in the case of an excessive torque applied to the mounting screws.

The closing member is constructed such that it seals the interior of the polygonal tube toward the recess. As a result, the mounting points of the polygonal tube section are arranged in a region of the closing member, which does not carry compressed air. The openings in the polygonal tube, through which the mounting screws of a screw connection extend between the polygonal tube and the machine, need not be sealed. The shape and the position of the recess ensure an adequate staying of the end of the polygonal tube.

The closing member of the invention seals the interior of the polygonal tube in a reliable and stable manner for a long duration. Simultaneously with the sealing effect, it is possible to secure the closing member in its position against the air pressure prevailing in the interior of the polygonal tube without additional auxiliary means. A possibly needed repair of the polygonal tube that forms the mounting rod, is easily possible and requires little labor for disassembly and assembly also when the polygonal tube is installed as a part of a mounting rod between other polygonal tubes.

BRIEF DESCRIPTION OF THE DRAWINGS

Further details of the invention will become apparent from the embodiment that is described in greater detail below, with reference to the Figures, in which.

DETAILED DESCRIPTION OF THE PREFERRED EMBODIMENT

Figure 1:
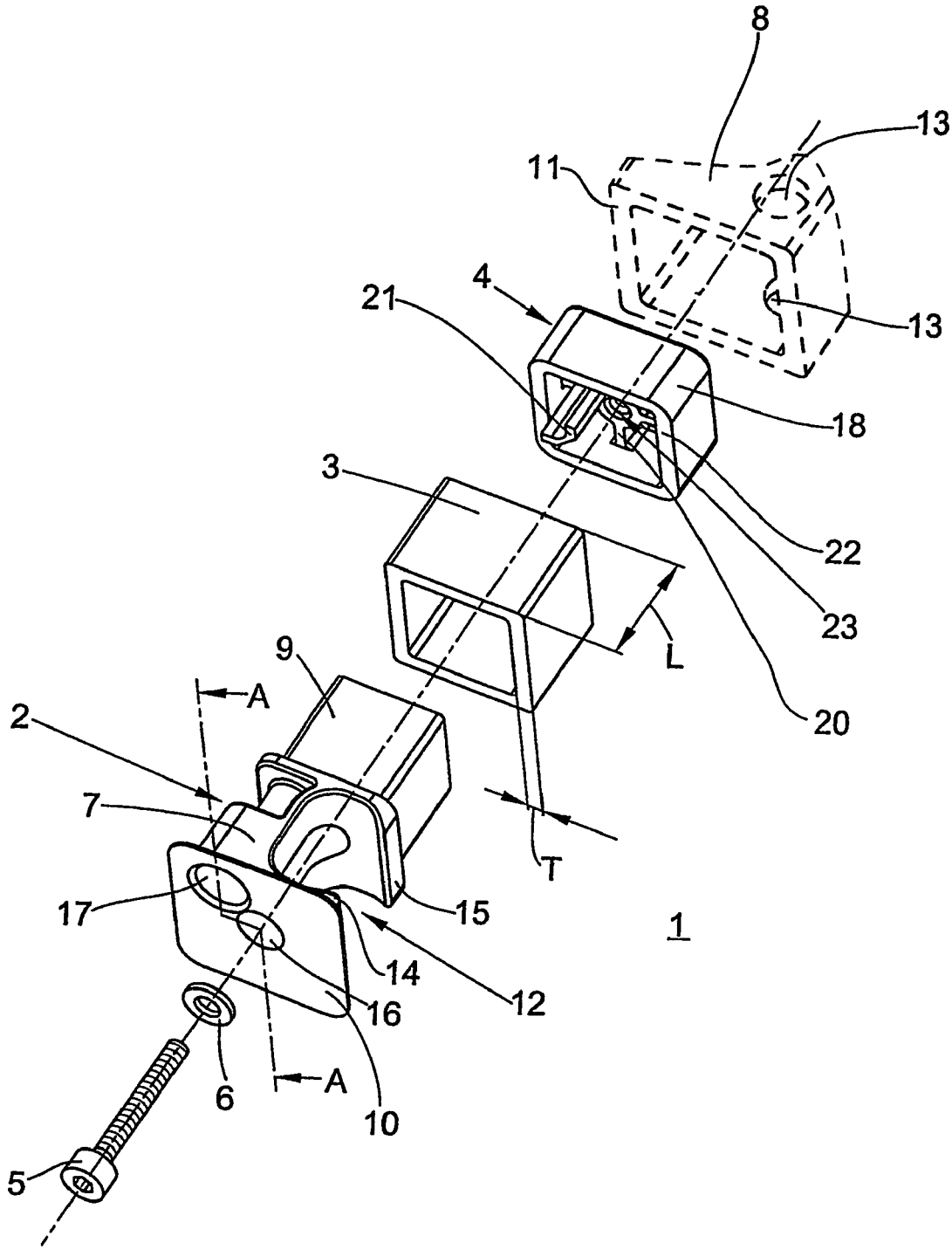
FIG. 1 is a perspective view of the individual parts of a closing member which embodies the invention before its assembly.

Referring more particularly to the drawings, there is illustrated a preferred embodiment of a closing member at 1 which embodies the invention. The member 1 comprises an end piece 2, a sealing element 3, and a counterpart 4, which are aligned along a central axis which is shown by the dashed line in FIG. 1. The member 1 also includes a threaded member 5, and a sealing washer 6, which are also positioned along the central axis.

The end piece 2 comprises a guide section 7, whose outer contour is adapted to the inner contour of a polygonal tube 8 shown in phantom lines in FIG. 1. The polygonal tube 8 is made square or of some other rectangular configuration. Adjacent the guide section 7 is a sealing section 9 with an outer contour of the same shape. The width and height of the outer contour of sealing section 9 are made somewhat smaller than the width and height of the guide section 7.

At the end of the end piece 2 that faces the sealing section 9, a stop 10 is formed, which interacts with an end face 11 of the polygonal tube 8, and prevents the closing member 1 from being pulled or pushed into the polygonal tube 8 beyond a desired position. The guide section 7 includes a transverse recess 12. Through this recess 12 and bore holes 13, a mounting screw extends, which is not shown for reasons of simplification, and which is used to secure the polygonal tube to a bracket or stand. On both axially separated sides of the recess 12, a supporting contour 14, 15 is formed, which counteracts a deformation of the hollow polygonal tube 8. The recess 12 in end piece 2 is dimensioned adequately large for the mounting screw, so as to be universally suited and usable for different screw sizes and screw positions that are dependent on the design of the stands. Along the central axis, the stop 10 includes an axial opening of a feed channel 16 for the threaded member 5, and in off-center relationship, an outlet of a connecting channel 17 for carrying the compressed air.

The contoured shape of the sealing element 3 corresponds to the polygonal tube 8 and sealing section 9, with the inner contour of the sealing element 3 being adapted to the outer contour of the sealing section 9, and the outer contour of the sealing element 3 to the inner contour of the polygonal tube 8. The sealing element 3 preferably consists of elastically deformable rubber. The wall thickness T of the sealing element 3 is somewhat smaller than the spacing that is present between the inner side of the polygonal tube 8 and the outer side of the guide section 7, when the closing member 1 is inserted into the polygonal tube 8. The length L of the sealing element 3 amounts to a multiple of the wall thickness T, and is dimensioned such that the counterpart 4 can adequately bias the sealing element 3 with axial pressure.

Figure 2:
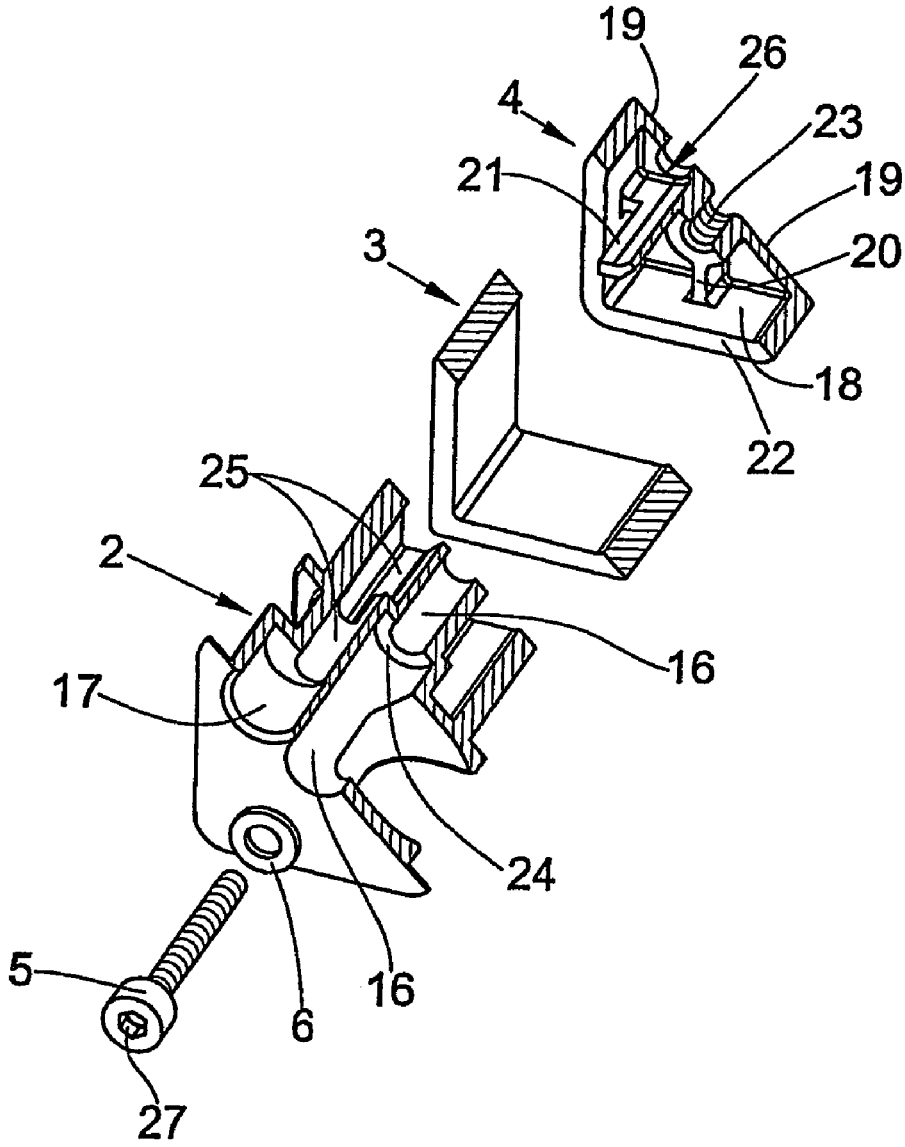
FIG. 2 is a partially sectioned view of the parts of the closing member shown in FIG. 1.

The counterpart 4 comprises a hollow section 18 of the same contoured shape as the sealing element 3, and is closed at one end by a rear wall 19 as best seen in FIG. 2. The rear wall 19 includes in inwardly directed relationship a support element 20 and a channel element 21. With its edge 22, the hollow section 18 projects beyond the support element 20. The channel element 21 projects even beyond the edge 22. The counterpart 4 can be joined in mating relationship with the end piece 2, only when the somewhat projecting channel element 21 assumes its correct position. In the embodiment shown in FIG. 1, the correct position of the channel element 21 is on the top left in the counterpart 4. This ensures the necessary flow of the compressed air. Through the center of the rear wall 19 and support element 20, a bore 23 extends, into which a screw thread is cut. Both the end piece 2 and the counterpart 4 preferably consist of a suitable metal, such as die-cast zinc.

The sectional view of FIG. 2 shows further details of the configuration of closing member 1. In the interior of end piece 2, the feed channel 16 changes to a smaller diameter. The transition to the smaller diameter of the feed channel 16 is shaped as a shoulder 24. The connection channel 17 changes to a compressed air channel 25, which has a smaller operative cross section than the connection channel 17.

In the counterpart 4, one can note a passageway opening 26 for the compressed air. The channel element 21 forms a part of the extension of compressed air channel 25.

When assembling the closing member 1, one begins with sliding the sealing element 3 onto the sealing section 9 of the end piece 2 as far as the guide section 7. Subsequently, one inserts the threaded member 5 together with the sealing washer 6 into the feed channel 16, with the sealing washer 6 being placed on the shoulder 24. The end of threaded member 5 is turned into threaded bore 23 of the counterpart 4 only so far that it engages the screw thread, and that the counterpart 4 does not yet exert an axial pressure on the sealing element 3.

The thus preassembled closing member 1 is inserted into the end of the polygonal tube 8 as far as the stop 10. Subsequently, one tightens the threaded member 5, whose head includes a hexagon socket 27, so that the end piece 2 axially exerts with its edge 22 a pressure on the sealing element 3. This causes the sealing element 3 to expand against the inner side of the polygonal tube 8, to secure the position of the closing member 1 against the air pressure developing in the interior of the polygonal tube 8, and to form a seal in an airtight manner between the polygonal tube 8 and the end piece 2.

Figure 3:
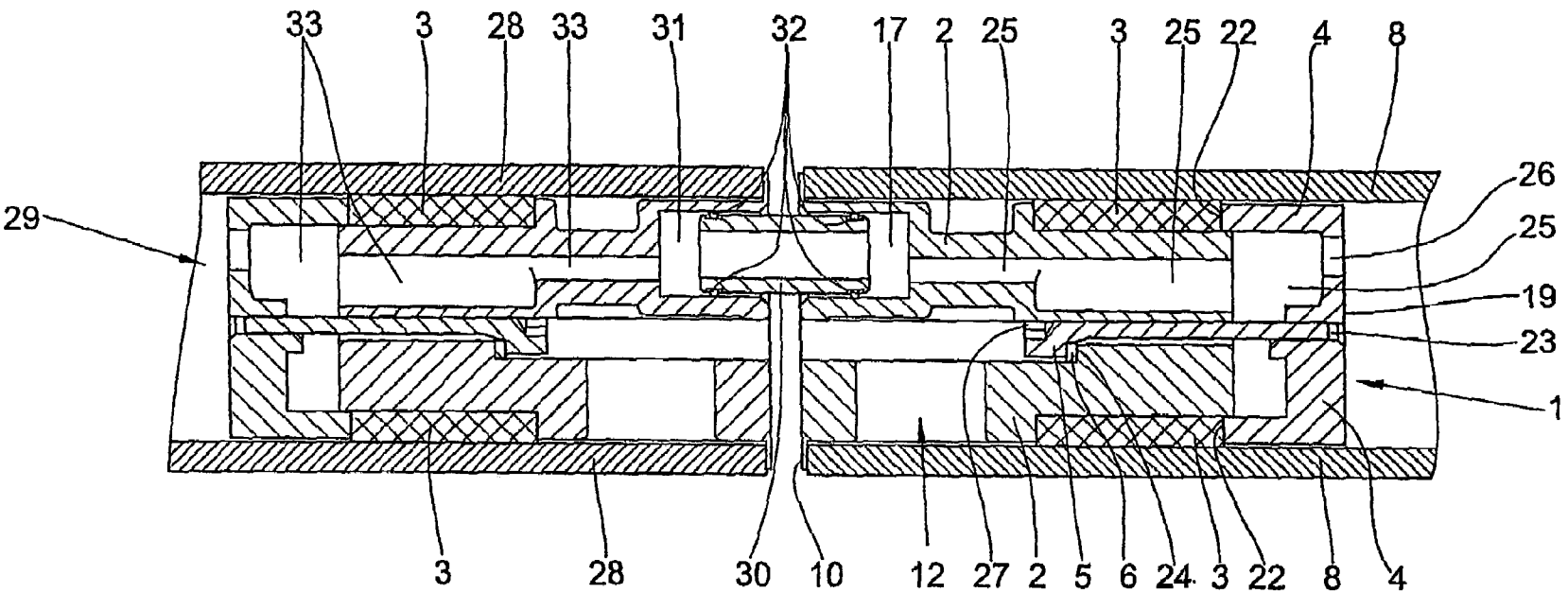
FIG. 3 is a sectional view of the end region of two polygonal tubes, each with a closing member and a connecting tube and taken along the line A-A of FIG. 1.

A closing member 1 in this state is shown in FIG. 3. The compressed air is allowed to flow through the closing member 1 from the passageway opening 26, via the compressed air channel 25 to the connection channel 17, or in the opposite direction. Adjacent at a small distance from the polygonal tube 8 is a second polygonal tube 28. A closing member 29 inserted into the polygonal tube 28 is made mirror-inverted with closing member 1. The closing member 1 and closing member 29 are interconnected by a connection tube 30, which is inserted with its ends into the connection channel 17 and connection channel 31. With that, compressed air is allowed to flow unimpeded between the polygonal tube 8 and polygonal tube 28 through compressed air channels 25 and 33. The connection tube 30 is sealed by means of O-ring seals 32 as disclosed in DE 198 30 048 A1.

The invention is not limited to the described embodiments. Within the scope of the invention, alternative configurations are possible, in particular of the end piece and the counterpart.

The invention claimed is:

1. A closing member for being inserted in a sealing manner in the end of a compressed air delivery polygonal tube on a yarn spinning machine, comprising an elastic sealing element, and with the closing member being configured such that it axially biases in its inserted state the sealing element, whereby the sealing element radially deforms so as to seal the closing member relative to the polygonal tube.

2. The closing member of claim 1, wherein the closing member is constructed such that compressed air is allowed to flow from the polygonal tube through the closing member into an adjacent polygonal tube.

3. The closing member of claim 1, wherein the closing member further comprises an end piece and a counterpart, with the sealing element being constructed and arranged between the end piece and the counterpart in such a manner that the sealing element radially expands by a relative movement of the end piece and counterpart toward each other.

4. The closing member of claim 3, wherein the end piece and the counterpart are interconnected by means of a threaded member that extends through the sealing element, and that the end piece and the counterpart bias the sealing element with axial pressure by tightening the threaded member.

5. The closing member of claim 4, wherein the end piece and the counterpart are constructed such that they jointly form a compressed air channel which extends in off-center relationship through the closing member.

6. The closing member of claim 5, wherein the compressed air channel includes an opening in an outer end face of the end piece, with the opening being configured to receive a connection tube for connection to a like closing member of mirror inverted configuration.

7. The closing member of claim 1, wherein the length L of the sealing element amounts to at least 1.5 times its wall thickness T.

8. The closing member of claim 1, wherein the sealing element consists essentially of rubber.

9. The closing member of claim 3, wherein the end piece includes a transverse recess which is constructed for receiving different mounting screws.

10. The closing member of claim 9, wherein a supporting contour for the polygonal tube is formed on both sides of the recess.

11. A closing member for being inserted in a sealing manner in the end of a compressed air delivery polygonal tube on a yarn spinning machine, comprising an end piece, a counterpart, an elastic sealing element disposed between the end piece and the counterpart, a threaded member interconnected between the end piece and the counterpart, whereby the threaded member is able to draw the counterpart toward the end piece and thereby radially expand the sealing element.

12. The closing member of claim 11 wherein the end piece, the counterpart, and sealing element are aligned along a central axis, and wherein the sealing element has a generally rectangular outer periphery and a generally rectangular bore when viewed in transverse cross section.

13. The closing member of claim 12 wherein the threaded member extends along the central axis and passes through the bore of the sealing element.

14. The closing member of claim 13 wherein the sealing element has opposite end faces which lie in respective planes which are perpendicular to the central axis, and wherein the end piece has an end face engaging one of the end faces of the sealing element and the counterpart has an end face engaging the other end face of the sealing element.

15. The closing member of claim 14 wherein the end piece and the counterpart have cooperating air passages which form a compressed air channel which extends off-center from said central axis through the length of the closing member.

16. The closing member of claim 15 wherein the counterpart includes a projecting channel element which is positioned to engage the air passage of the end piece to assure that the cooperating air passages are aligned.

17. The closing member of claim 16 wherein the end piece includes a sealing section of generally rectangular outline in transverse cross section and which conforms to the rectangular outline of the bore of the sealing element, and with the sealing element being disposed upon the sealing section.

18. A mounting rod for the pneumatically loadable top roller support and weighting arms in a drafting system on a yarn spinning machine, said mounting rod comprising a pair of polygonal tubes of like cross sectional configuration positioned in an oppositely facing end to end relationship, a closing member disposed in each of the adjacent ends of the polygonal tubes, with each of the closing members comprising an end piece, a counterpart, an elastic sealing element disposed between the end piece and the counterpart, and a threaded member interconnected between the end piece and the counterpart, whereby the threaded member is able to draw the counterpart toward the end piece and thereby radially expand the sealing element, wherein the end piece, the counterpart, and sealing element are aligned along a central axis, and wherein the end piece and the counterpart have cooperating air passages which form a compressed air channel which extends off-center from said central axis through the length of the closing member, said closing members being disposed in an oppositely oriented relationship to each other and so that the end pieces are adjacent to each other and so that the compressed air channels are aligned, and a connecting tube interconnected in a sealed manner between the aligned compressed air channels of the adjacent end pieces.

19. The mounting rod of claim 18 wherein the pair of polygonal tubes are of like cross sectional configuration in transverse cross section, with each tube defining a bore of rectangular outline, and wherein the elastic sealing element of each closing member has an outer rectangular outline which closely conforms to that of the bore of the associated tube.

* * * * *

UNITED STATES PATENT AND TRADEMARK OFFICE

CERTIFICATE OF CORRECTION

PATENT NO. : 7,287,367 B2
APPLICATION NO. : 11/151379
DATED : October 30, 2007
INVENTOR(S) : Birkenmaier et al.

It is certified that error appears in the above-identified patent and that said Letters Patent is hereby corrected as shown below:

Title page, insert the following:

--(30) Foreign Application Priority Data

Jan. 25, 2003 (DE) 103 02880.3--.

Signed and Sealed this

Eighth Day of April, 2008

JON W. DUDAS
*Director of the United States Patent and Trademark Office*